United States Patent [19]

Moldrup et al.

[11] Patent Number: 4,548,839

[45] Date of Patent: Oct. 22, 1985

[54] METHOD FOR WOOD PRESERVATION

[76] Inventors: Steen Moldrup, Magstraede 4, 1204 Copenhagen K; Niels Moldrup, Fyenvej 23, 7330 Brande, both of Denmark

[21] Appl. No.: 591,798

[22] Filed: Mar. 21, 1984

[30] Foreign Application Priority Data

Mar. 29, 1983 [DK] Denmark ..... 1421/83

[51] Int. Cl.[4] ..... B05D 1/18; B05D 1/40; B05D 3/12

[52] U.S. Cl. ..... 427/345; 427/377; 427/440

[58] Field of Search ..... 427/377, 345, 440

[56] References Cited

U.S. PATENT DOCUMENTS 2,650,885 9/1953 Hudson ..... 427/351 X
3,967,011 6/1976 Dunn et al. ..... 427/440 X

FOREIGN PATENT DOCUMENTS 84711 8/1953 Norway .
71149371 11/1971 Sweden .

*Primary Examiner*—Michael R. Lusignan
*Attorney, Agent, or Firm*—Kenyon & Kenyon

[57] ABSTRACT

A method of removing liquid solvent from wood after pressure treatment with a preservative solution evaporates the excess solvent by mechanically circulating heated vapor of the same solvent used in the preservative solution past the wood in an autoclave. The autoclave is maintained at a constant pressure by transferring evaporated solvent to a condenser at a rate equal to the evaporation rate of solvent from the wood in the autoclave. The heat extracted from the condensing solvent vapor provides the heat to the circulating vapor in the autoclave for evaporating additional liquid solvent from the treated wood. Preferably, the vapor transferred from the autoclave is compressed before its delivery to the condenser so that the heat needed for evaporation in the autoclave can be obtained by simple heat transfer of the excess heat from the condenser.

5 Claims, 1 Drawing Figure

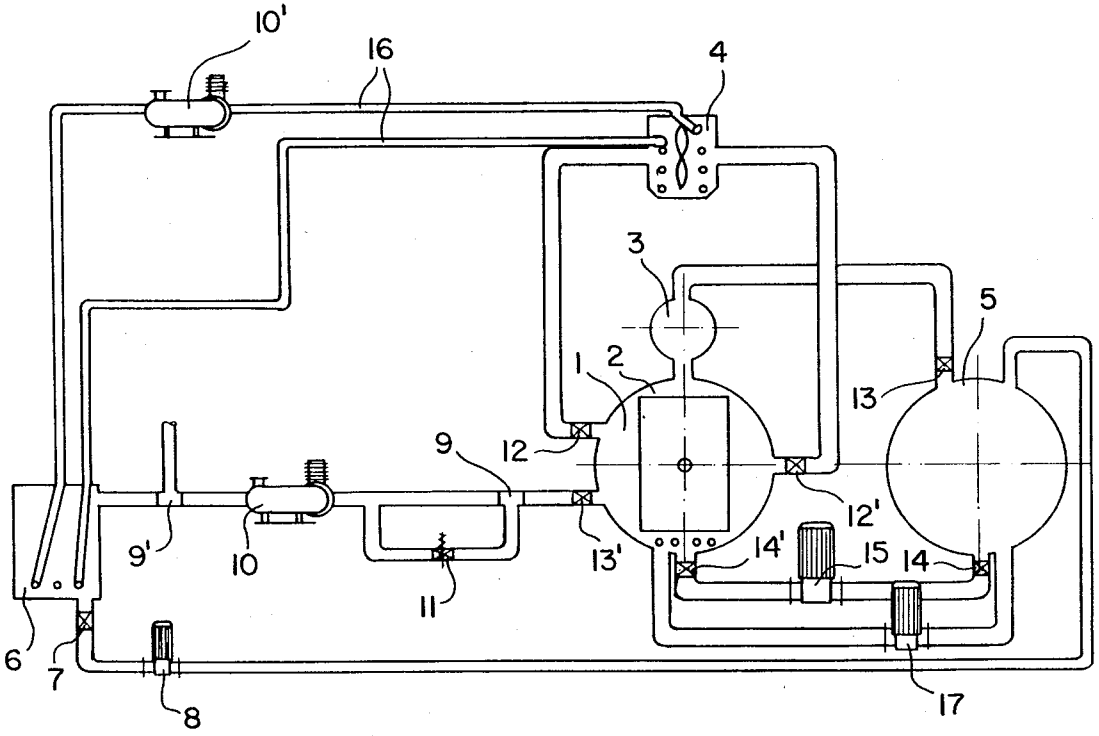
5
13
4
3
2
1
12
12'
13'
14
14'
15
17
9
9'
10
10'
11
16
8
7
6

METHOD FOR WOOD PRESERVATION

The invention relates to a method for preserving timber and other wood products with a preservative liquid consisting of preservative substances dissolved in a solvent, by which method the solvent used for the preservative liquid is evaporated from the preserved wood and recovered in a condenser after the preservative substances dissolved in the preservative liquid have been pressed into the wood, and the medium for transferring the heat necessary for evaporating the solvent from the impregnated wood is vapor of the solvent used in the preservative liquid.

It is commonly known to impregnate wood with preservative material consisting of fungicides, insecticides, non-inflammable chemicals, dyes and/or water-repellent substances dissolved in water or in another vaporizing solvent, in order to protect the impregnated wood against disintegration caused by the weather, biological organism and/or fire.

The solvent helps to introduce the preservative material into the wood, but in general it has itself no long influence on the impregnated wood, and generally the solvent evaporates very quickly therefrom. In most impregnating processes, the evaporation of the solvent takes place after the impregnated wood has been removed from the impregnating plant, but there are also examples of impregnating methods in which the solvent evaporates from the impregnated wood while the wood is still in the impregnating plant. However, contrary to the present invention, these methods are characterized by the evaporation of the solvent from the impregnated wood being dependent on heating or cooling from outside or by the coupling together of several plants to procure the necessary heating/cooling.

For many applications of wood it is unimportant whether the wood contains solvent, but this is not the case for all applications of wood. For painting or gluing it is very often disadvantageous if the types of solvents will decrease the fire resistance of the wood as long as the solvent is in the wood. An uncontrolled evaporation of solvent from impregnated wood may result in harm to human beings, animals, and plants and damage to objects, for instance where turpentine and other organic solvents are used.

In order to evaporate a solvent from the impregnated wood it is today common practice to dry the wood in an artificial drying chamber, where hot unsaturated air is circulated past the wood to increase the evaporation rate of the solvent liquid from the impregnated wood. However, this is an expensive and in many ways a difficult process, because an additional production link has to be inserted, and because considerable amount of heat is consumed for the evaporation of the solvent.

To be profitable to evaporate the solvent from the impregnated wood in the impregnating plant, the evaporation must be completed within a maximum of 3-4 hours, which is very difficult to practice by having hot, unsatuated air circulating past the wood pieces. As atmospheric air has a relatively small heating capacity, and to transfer sufficiently quickly the heat necessary for the evaporation of the solvent, an inconveniently great air circulation in the impregnating plant will be necessary.

The purpose of the invention is to provide a method whereby the solvent quickly and effectively may be removed from the treated wood, and wherein the medium for transferring the heat necessary for evaporating the solvent from the impregnated wood is vapor from the solvent used in the preservative liquid.

By using as a heat transfer medium the vapor of the solvent used in the preservative liquid, it will be possible to evaporate and recover the solvent in a closed cycle, in which the heat necessary for evaporation of the solvent is induced as excess heat from the condensation of evaporated solvent in a condenser.

By using vapor from the solvent in the preservative liquid it is achieved further that no heat transfer liquid remains in the wood. If the solvent used in the preservative liquid also has to function as a heat transfer medium, it is important that the solvent vapor have a great heat capacity, which means that the solvent in vapor form must have a high specific heat, density and specific gravity.

The heat capacity of the solvent is increased by compressing the solvent vapor in an autoclave, where the wood has been treated when the solvent is evaporating from the impregnated wood. The solvent vapor, however, should not be compressed so much that it is saturated and thereby prevents further evaporation.

When vapor from the solvent used in the preservative liquid is used as a heat transmission medium, the autoclave must be supplied with a blower or the like to circulate the solvent vapor past all the wood pieces and heating tubes, which tubes are mounted in the autoclave or in connection with the blower. By passing the heating tubes the solvent vapor will be heated, and this heat will later be transferred to the impregnated wood when the vapor circulates past the wood.

During the evaporation of the solvent from the impregnated wood a constant pressure must be maintained in the autoclave as well as in the condenser, as according to the invention there may be a possibility in a very simple way to transfer the excess heat in the condenser to the autoclave, where the heat will be consumed in evaporating the solvent.

It is not necessary to maintain the same pressure in the autoclave as in the condenser. On the contrary, it is often an advantage if the pressure in the condenser is higher than the pressure in the autoclave, as it will thus be possible by means of a circulating pump to transfer excess heat from the condenser to the autoclave merely by circulating a heat transfer liquid or vapor through a closed circuit comprising cooling tubes in the condenser and heating tubes in the autoclave, which are connected with another through a supply pipe and a return pipe.

In case the pressure in the condenser is not higher than the pressure in the autoclave, the excess heat in the condenser is transferred to the autoclave by means of a heating pump, and also in this case the quantity of heat developed in the condenser according to the present invention corresponds exactly to the quantity of heat consumed in the autoclave for evaporation of the solvent in the impregnated wood.

By providing a storage tank for preservative liquid and ensuring that saturated vapor is present in the storage tank, it will be possible to pump liquid from the storage tank to the autoclave without taking in air from outside to the storage tank.

Preferably the pressure in the autoclave is regulated during evaporation of the solvent from the impregnated wood by means of a regulating system, such as a pressure switch, to retain the solvent vapor in the autoclave until the desired pressure is developed in the autoclave, the desired pressure depending on the boiling point temperature of the solvent.

When the desired pressure is established, the regulating system shall further take care of maintaining a constant pressure in the autoclave by continuously discharging a volume of solvent vapor from the autoclave corresponding to that evaporated at any time from the impregnated wood. In this way, the consumption of heat in the autoclave automatically corresponds to the quantity of heat developing by condensation of solvent vapor in the condenser.

Furthermore, the regulating system makes it possible to maintain different pressures in the autoclave and in the condenser to facilitate heat transfer from the condenser to the autoclave.

In a further preferred aspect of the method according to the invention, a self regulating cycle is obtained, and the rate of the evaporation of the solvent from the impregnated wood depends only on the rate of transfer to the impregnated wood of the heat being produced by condensation of the solvent vapor in the condenser.

In a still further aspect of the method according to the invention, a simple heat transfer is obtained by establishing a higher pressure in the condenser than in the autoclave, preferably by means of a compressor placed in the supply pipe between the autoclave and condenser.

The invention will be further described in the following section with reference to the drawing, which shows a plant for performing the method according to the invention.

The drawing shows an autoclave 1 having an inside rack 2 which rotates about the longitudinal axis of the autoclave 1. A conventional expansion tank is mounted above the autoclave. Preservative liquid is stored in a storage tank 5 connected with a condenser 6. From the condenser the solvent may be transferred to the storage tank 5 by a transport pump 8 when a discharge valve 7 is open. Through a three-way-valve 9 and a pneumatic regulated valve 11 the autoclave 1 is connected via a further three-way-valve 9' to the condenser 6.

A blower is placed in a chamber 4 containing heating tubes. By means of two control valves 12, 12', the blower chamber 4 may be connected with the autoclave 1 to permit circulation of a heat transfer medium. Valves 13 and 13' shut off branch lines in the plant. 14 and 14' indicate two valves through which a transfer pump 15 may pump the solvent between the autoclave and the storage tank. 17 designates a pressure pump.

The impregnation of the wood and the subsequent recovery of the solvent from the impregnated wood is carried out according to the invention in the following way:

The wood is brought into the autoclave 1 on impregnating carriages, roller conveyors, or similar transporting systems. Thereafter the cover (not shown) of the autoclave is closed.

When the cover has been closed, the autoclave is evacuated by means of a vacuum pump 10. In the case that the impregnating process preferably should be executed as an empty-cell process, the evacuation may in certain cases be postponed to the end of the impregnating process.

After evacuation, the process continues according to one of the two following methods:

Method a.

The autoclave 1 is filled with the preservative liquid from the storage tank 5 by gravity flow, a transfer pump 15, or an excess of pressure in the storage tank.

When the autoclave has been filled totally with preservative liquid, all valves to the autoclave are closed, and the pressure pump 17 is started, whereby the liquid in the autoclave is pressurized. The autoclave may also be pressurized by heating the preservative liquid in the autoclave or by means of compressed air.

As soon as the wood has been impregnated with the desired quantity of preservative liquid, the autoclave is depressurized and drained of surplus preservative liquid. The liquid is conveyed back to the storage tank 5 by a transfer pump, gravitation, or an overpressure in the autoclave 1.

The impregnation of wood according to the above method differs from the traditional impregnating methods in the following points:

In the method of the present invention it is easy to use a volatile chlorfluorine-carbon compound as the solvent in the preservative liquid.

According to the present invention it is further possible to protect the preservative liquid in the plant from contact with oxygen in the atmosphere. By using a volatile chlorfluorine-carbon compound as a solvent, the space above the preservative liquid in the storage tank will be saturated with solvent vapor, whereby it is possible, contrary to using a solvent with a higher boiling point, to pump the liquid from the storage tank over the autoclave with a pressure pump without introducing air into the storage tank. Especially when treating cabinet-grade wood it is of great advantage that the preservative liquid may be stored under oxygen-free conditions. In this way, it will be possible to use easily oxidized akyloils and resins, etc. in the preservative liquid without the risk that these materials will polymerize in the preservative liquid, resulting in a reduced penetration of the liquid into the impregnated wood or timber.

Method b.

By building the autoclave with a device for rotating the wood around the longitudinal axis of the autoclave as described in the British Pat. No. 2 045 303, it will be possible to impregnate the wood even if the autoclave is filled only partially with the preservative liquid, and in many cases this has a number of advantages.

Many preservative liquids are rather expensive, and for these preservative liquids it is a considerable advantage if the autoclave needs to be only partially filled with preservative liquid. Further, a number of the preservative liquids being used to impregnate cabinet wood is relatively unstable, so that it is important that the preservative liquid in the plant be as fresh as possible. This is easily obtained by having as small amounts of the preservative liquid in the autoclave at one time as possible. By impregnating wood in an autoclave only partly filled with preservative liquid, it will be possible in a plant corresponding to the plant according to the British Pat. No. 2 045 303 to regulate the impregnation of preservative liquid into the wood very exactly and to avoid excess impregnation in certain wood pieces.

Impregnation of wood in an autoclave only partly filled with preservative liquid is performed in the following way:

The autoclave 1 is filled partly, for example 25%, with preservative liquid. Thereafter, by rotating the wood in the autoclave around the longitudinal axis of the autoclave, the wood will be covered with a thin film of preservative liquid, and this preservative liquid is then forced into the wood by pressurizing the autoclave by filling the space above the preservative liquid with compressed vapor or compressed air.

When the preservative liquid film on the wood has been forced into the wood, the pressure in the autoclave is removed. The procedure may possibly be repeated until the desired quantity of preservative liquid has been absorbed by the wood.

After emptying the autoclave of preservative liquid, the second stage is commenced, where the solvent, which was forced into the wood during the impregnating process, will be evaporated from the wood and recovered, whereas the preservative substances remain in the wood.

When vapor from the solvent used in the preservative liquid is used as a heat transfer medium, the evaporation and recovery of the solvent from the impregnated wood is performed in the following way:

After the autoclave has been emptied of excess preservative liquid, the vapor of the solvent used in the preservative liquid is circulated through the autoclave by means of a blower. While circulating through the autoclave 1, the vapor is heated by heating tubes mounted either in the autoclave or in a chamber 4 housing the blower. The heated vapor thereafter will transfer heat to the impregnated wood and hereby boil the solvent in the impregnated wood out of the wood.

In order to obtain a sufficiently great heating capacity of the heat transfer vapor, a certain overpressure is achieved in the autoclave 1 during evaporation of the solvent, and for establishing this pressure it may be necessary to supply heat or solvent vapor from the outside.

After the desired pressure has been obtained in the autoclave 1, a constant pressure in the autoclave is maintained by continuously discharging a quantity of solvent vapor from the autoclave corresponding to the amount evaporated from the impregnated wood. The solvent vapor discharged from the autoclave is condensed in the plant's condenser 6, and the energy released thereby corresponds exactly to the energy used at the same time in the autoclave to evaporate the solvent from the impregnated wood. By transferring the excess heat from the condenser to the autoclave, a system in balance is obtained, which is self regulating and which does not require supply of heat or cooling from the outside.

Experiments have shown that the most effective and uniform evaporation of solvent from the impregnated wood is obtained by rotating the wood around the longitudinal axis of the autoclave, as described in the British Pat. No. 2 045 303.

As soon as the main part of the solvent has evaporated from the impregnated wood, the autoclave is evacuated, whereby the last solvent is removed from the impregnated wood, and the autoclave is emptied of solvent vapor, so that no vapor may escape to the surrounding when the autoclave is opened for taking out the completed impregnated wood.

The heat produced in the condenser or during the finishing vacuum cannot be transferred immediately to the impregnated wood due to the evacuation of the heat transfer vapor, the heat therefore has to be delivered to the surroundings by means of a cooling plant.

The solvent used in the preservative liquid must have a boiling point adapted according to the pressure and the temperature in the autoclave during the evaporating phase. As the solvent is boiled out of wood, it will be necessary that the solvent, at the pressure used in the autoclave for the evaporation of the solvent, have a boiling point lower than the temperature to which the heat transfer medium is heated.

In order to avoid the use of a high temperature or low pressures in the autoclave for boiling the solvent out of wood, it is most advantageous to use solvents with a relatively low boiling point. The solvent ought besides to have a low specific heat of evaporation, and it should have a good dissolving capacity for the preservative substances. The solvent ought besides to be chemically stable and to be chemically inactive towards the preservative chemicals or towards those materials forming part of the construction of the plant. The used solvent must be neither inflammable nor decomposed.

In the cases where the solvent is used both as a heat transfer medium and as a solvent for the preservative materials used in the process, the solvent should also have a high heating capacity in the vaporized condition and a high specific gravity and specific heat.

If vapor of the solvent in the preservative liquid is used as a heat transfer medium, the solvent must have a boiling point at atmospheric pressure lower than 75° C., because a higher boiling point will make it necessary to use a pressure for the evaporation of the solvent in the impregnated wood which is lower than 1 bar, or to use temperatures which are higher than 75° C., both of which should be avoided.

Among the preferred solvents are the halogenated solvents, of which, for example, the following may be mentioned:

Methylenechloride ($CH_2Cl_2$), trichlorotrifluoroethane ($CCl_2F$-$CClF_2$), trichlorofluoroethane ($CCl_3F$), dichlorofluoromethane ($CHCl_2F$), dichlorotetrafluoroethane ($CClF_2$-$CClF_2$) and monobromotrifluoromethane ($CBrF_3$).

Among the most suitable halogenated solvents are the chlorofluorocarbon compounds. Experiments with various chlorofluorocarbon compounds as solvents have shown that the chlorofluorocarbon compounds are especially suitable solvents for impregnation of wood. The chlorofluorocarbon compounds are characterized in that they are non-flammable, chemically stable and chemically inactive towards most types of paints, glue, plastic and metals. Further they have a small heat of evaporation, and as vapors they possess a relatively high heat capacity in relation to atmospheric air.

We claim:

1. A method for preserving wood, the method including the steps of placing the wood into an autoclave, tranferring a preservative liquid containing preservative substances dissolved into a solvent from a storage tank to an autoclave, pressurizing the autoclave to impregnate the wood with a portion of the preservative liquid, returning the remaining preservative liquid from the autoclave to the storage tank, reducing the pressure in the autoclave to a level below the saturation pressure of the solvent corresponding to the temperature in the autoclave, heating solvent vapor to a temperature higher than the boiling point of the solvent at the reduced pressure in the autoclave, and contacting the impregnated wood with the heated solvent vapor to evaporate at least part of the solvent from the wood, wherein the improvement comprises:

said step of contacting the wood with the heated solvent vapor comprises mechanically circulating the heated solvent vapor past the wood in the autoclave; and the method further comprises maintaining a vapor pressure in the autoclave as high as possible without reaching saturation pressure of the solvent so as to increase the heat capacity of the circulating solvent vapor.

2. A method for preserving wood according to claim 1, further comprising:

maintaining a temperature and pressure in the storage tank such that the space above the preservative liquid is saturated with solvent vapor.

3. A method for preserving wood according to claim 1 or 2 wherein the method further comprises:

transferring part of the evaporated solvent to a condenser;

extracting heat from the transferred solvent vapor in the condensor to condense the solvent vapor; and regulating the rate of solvent vapor transfer to the condenser to equal the evaporation rate of solvent from the impregnated wood.

4. A method for preserving wood according to claim 3 wherein the step of heating solvent vapor comprises:

transferring at least part of the heat obtained from the condensing solvent vapor in the condenser to said mechanically circulated solvent vapor prior to contacting the wood with said heated solvent vapor.

5. A method for preserving wood in accordance with claim 3 wherein the step of transferring a part of the evaporated solvent to a condenser comprises:

compressing the solvent vapor being transferred from the autoclave to the condenser to maintain a pressure in the condenser higher than the pressure in the autoclave during the evaporation of solvent from the impregnated wood.

* * * * *

UNITED STATES PATENT AND TRADEMARK OFFICE

CERTIFICATE OF CORRECTION

PATENT NO. : 4,548,839

DATED : October 22, 1985

INVENTOR(S) : Steen Moldrup et al.

It is certified that error appears in the above-identified patent and that said Letters Patent is hereby corrected as shown below:

Column 2, line 49, between "with" and "another" add the word --one--.

Column 5, line 27, change "hereby" to --thereby--.

Column 6, line 55, change "to an autoclave" to --to the autoclave--.

Column 7, line 19, change "condensor" to --condenser--.

Signed and Sealed this

*Twenty-fifth* Day of *March 1986*

[SEAL]

*Attest:*

DONALD J. QUIGG

*Attesting Officer*

*Commissioner of Patents and Trademarks*